US012370396B2

(12) United States Patent
Jones et al.

(10) Patent No.: US 12,370,396 B2
(45) Date of Patent: Jul. 29, 2025

(54) DUAL-HANDLED, WEIGHTED EXERCISE DEVICE

(71) Applicants: Tyler Jones, Henderson, NV (US); Justin Jones, Henderson, NV (US); Vincent Pangallo, Lebanon, TN (US)

(72) Inventors: Tyler Jones, Henderson, NV (US); Justin Jones, Henderson, NV (US); Vincent Pangallo, Lebanon, TN (US)

(73) Assignee: KMNCE LLC, Las Vegas, NV (US)

( * ) Notice: Subject to any disclaimer, the term of this patent is extended or adjusted under 35 U.S.C. 154(b) by 153 days.

(21) Appl. No.: 18/114,117

(22) Filed: Feb. 24, 2023

(65) Prior Publication Data

US 2024/0001191 A1 Jan. 4, 2024

Related U.S. Application Data

(60) Provisional application No. 63/314,210, filed on Feb. 25, 2022.

(51) Int. Cl.
*A63B 21/06* (2006.01)
*A63B 21/00* (2006.01)

(52) U.S. Cl.
CPC ..... *A63B 21/0604* (2013.01); *A63B 21/4035* (2015.10)

(58) Field of Classification Search
CPC .... A63B 21/06–0618; A63B 22/14–18; A63B 21/0604; A63B 21/4035; A63B 21/072
See application file for complete search history.

(56) References Cited

U.S. PATENT DOCUMENTS

| | | | | |
|---|---|---|---|---|
| D370,951 | S | 6/1996 | Lazar | |
| 5,692,996 | A * | 12/1997 | Widerman | A63B 21/072 482/106 |
| 5,795,275 | A | 8/1998 | Van Der Hoeven et al. | |
| 6,196,951 | B1 | 3/2001 | Shepherd | |

(Continued)

FOREIGN PATENT DOCUMENTS

| | | |
|---|---|---|
| CN | 304151936 | 10/2016 |
| KR | 200488780 | 7/2019 |
| WO | 2021080657 | 4/2021 |

OTHER PUBLICATIONS

PCT Notification of Transmittal of the International Search Report and the Written Opinion of the International Searching Authority, or The Declaration for PCT/US23/13875; 18 pages; mailed Jun. 6, 2023.

(Continued)

*Primary Examiner* — Nyca T Nguyen
(74) *Attorney, Agent, or Firm* — Snell & Wilmer L.L.P.

(57) ABSTRACT

An exercise device has a generally spheroidal body having a top, a bottom, a first side, a second side, a front, and a rear, a first handle extending outwardly from the first side, the first handle comprising a grip spaced from the body; and a second handle extending outwardly from the second side, the second handle comprising a grip spaced from the body, wherein the first and second handles extend upwardly towards the top of said body at an angle relative to a horizontal plane through the body. Exercise devices of different masses may have different sized bodies, but have approximately the same total width from handle to handle.

18 Claims, 3 Drawing Sheets

(56) References Cited

U.S. PATENT DOCUMENTS

| | | | | |
|---|---|---|---|---|
| 7,326,158 | B1 * | 2/2008 | Wang | A63B 43/02 482/8 |
| D568,950 | S | 5/2008 | Yewer | |
| 7,604,581 | B1 * | 10/2009 | Williams | A63B 21/0004 482/140 |
| 8,128,537 | B2 | 3/2012 | Signorile et al. | |
| D659,204 | S | 5/2012 | Cotter | |
| D689,153 | S * | 9/2013 | Brinkley | D21/662 |
| 8,636,625 | B2 * | 1/2014 | Johnson | A63B 21/072 482/44 |
| 8,944,971 | B2 | 2/2015 | Shorter | |
| 9,616,269 | B1 | 4/2017 | Burosh | |
| D789,461 | S | 6/2017 | Magloire | |
| D798,969 | S | 10/2017 | Lozito | |
| 9,844,695 | B1 * | 12/2017 | Shorter | A63B 21/075 |
| D811,018 | S * | 2/2018 | Toolan | D11/86 |
| 10,016,649 | B2 * | 7/2018 | Widerman | A63B 21/285 |
| 10,179,259 | B1 | 1/2019 | Zagata | |
| D843,510 | S | 3/2019 | Ross | |
| 10,532,241 | B2 * | 1/2020 | Boatner | A63B 21/0722 |
| D905,803 | S * | 12/2020 | Kim | D21/680 |
| D923,120 | S | 6/2021 | Smith | |
| 11,052,281 | B2 | 7/2021 | Saldate et al. | |
| 11,285,352 | B2 * | 3/2022 | Beall | A63B 23/03525 |
| D955,507 | S | 6/2022 | Wang | |
| 11,446,537 | B2 | 9/2022 | D'Alesio | |
| D968,536 | S | 11/2022 | Rogov | |
| D969,942 | S | 11/2022 | Puchlov | |
| D971,597 | S | 12/2022 | Bar | |
| D974,502 | S | 1/2023 | Beall | |
| D975,513 | S | 1/2023 | Richardson | |
| D978,992 | S | 2/2023 | McDonald | |
| 2005/0250627 | A1 * | 11/2005 | Park | A63B 21/06 482/93 |
| 2011/0111934 | A1 * | 5/2011 | Taylor | A63B 41/125 482/139 |
| 2012/0053024 | A1 * | 3/2012 | Mendoza | A63B 21/0722 482/106 |
| 2012/0115691 | A1 * | 5/2012 | Munroe | A63B 21/0004 482/110 |
| 2012/0309595 | A1 | 12/2012 | Dike | |
| 2012/0322631 | A1 | 12/2012 | Januszek | |
| 2013/0012367 | A1 | 1/2013 | Williams | |
| 2014/0256522 | A1 | 9/2014 | Holt | |
| 2017/0326404 | A1 | 11/2017 | Vardi | |
| 2018/0133539 | A1 * | 5/2018 | Hudson | A63B 21/0726 |
| 2018/0369636 | A1 * | 12/2018 | Munroe | A63B 21/0617 |
| 2021/0228931 | A1 * | 7/2021 | Beall | A63B 21/0602 |

OTHER PUBLICATIONS

Facebook, "Dimensions Standard for Competitions Kettlebell", Kettlebell Sports World League, Jul. 12, 2019 [retrieved 223-04-17]. Entire document. Retrieved from the Internet https://www.facebook.com/kettlebellworldleague/posts/detailed-dimensions-standard-for-competitions-kettlebellbesides-the-kettlebell-h/353826725307660/.

Notice of Allowance of U.S. Appl. No. 29/828,445; USPTO; Mailing date Sep. 14, 2023; 7 pages.

"Kamagon Exercise Ball" Oct. 15, 2013, Amazon, site visited Aug. 29, 2023: https://www.amazon.com/Kamagon-Exercise-Ball-9-inch-workout/dp/B00G4B9T2Y (Year: 2013), 1 page.

"Fibirret Yoga Fitness Water Filled Kettlebells" Dec. 24, 2022, Amazon, site visited Aug. 29, 2023: https://www.amazon.com/dp/BOBR1B8LL4/ref=sspa_dk_detail5? (Year: 2022), 1 page.

"BOSU HB25 (Water Filled Kettlebell)" Oct. 19, 2019, Amazon, site visited Aug. 29, 2023: https://www.amazon.com/HB25-Surge-Hydro-Ball-Black/dp/B07S57GDXR/ref=asc_df_B07S57GDRX/?tag=&linkCode=df0&hvadid=385184478202&hvpos=&hvnetw=g& (Year: 2019), 1 page.

* cited by examiner

DUAL-HANDLED, WEIGHTED EXERCISE DEVICE

RELATED APPLICATION DATA

The present application claims priority to U.S. Provisional Application Ser. No. 63/314,210, filed Feb. 25, 2022, which application is incorporated by reference herein in its entirety.

FIELD OF THE INVENTION

The present invention relates to exercise devices and equipment.

BACKGROUND OF THE INVENTION

A variety of devices are known for use in performing exercises. These devices include, but are not limited to dumbbells, barbells, and kettlebells. Most of this equipment has changed very little over time, even though the equipment has existing drawbacks.

SUMMARY OF THE INVENTION

One aspect of the invention is an exercise device having a generally spheroidal body having a top, a bottom, a first side, a second side, a front, and a rear, a first handle extending outwardly from the first side, the first handle comprising a grip spaced from the body, and a second handle extending outwardly from the second side, the second handle comprising a grip spaced from the body, wherein the first and second handles extend upwardly towards the top of said body at an angle relative to a horizontal plane through the body.

Exercise devices of different masses may have different sized bodies, but have approximately the same total width from grip to grip, and also have proportionately configured bodies.

The configuration of the exercise device has a number of advantages over existing exercise devices, a number of which are described in more detail herein.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
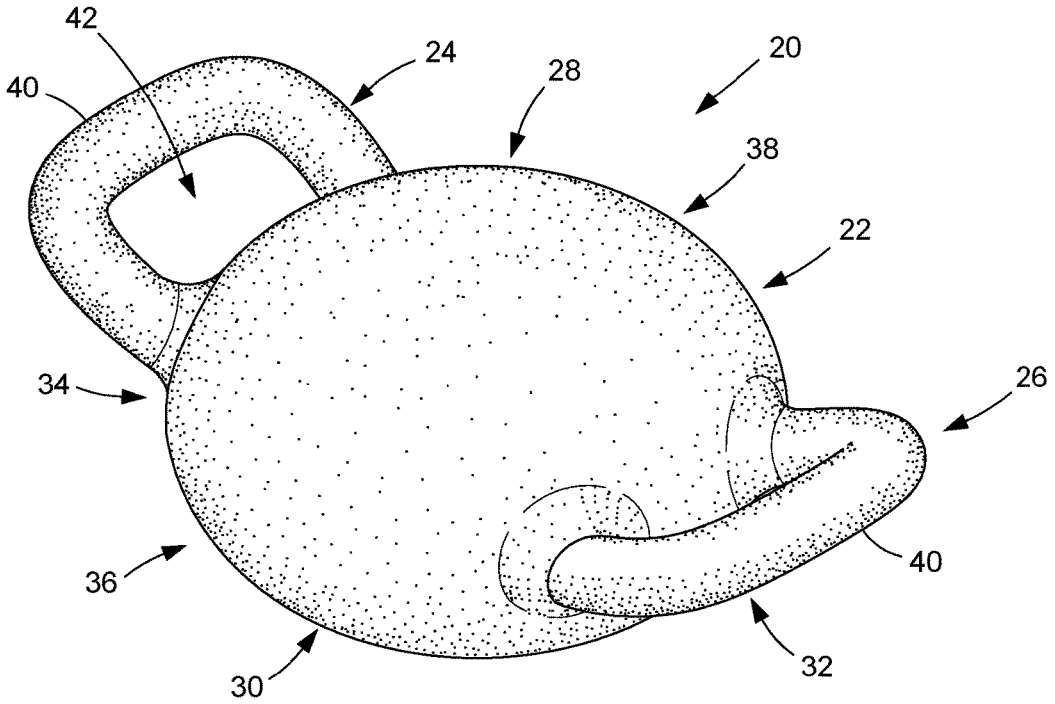
FIG. 1 is a top perspective view of an exercise device in accordance with an embodiment of the invention.

One embodiment of the invention is an exercise device 20. As illustrated in FIG. 1, the exercise device 20 has a body 22, a first handle 24 and a second handle 26.

The body 22 has an exterior surface with a top 28, a generally opposing bottom 30, a first side 32, a generally opposing second side 34, a front 36 and a generally opposing back or rear 38.

Figure 2:
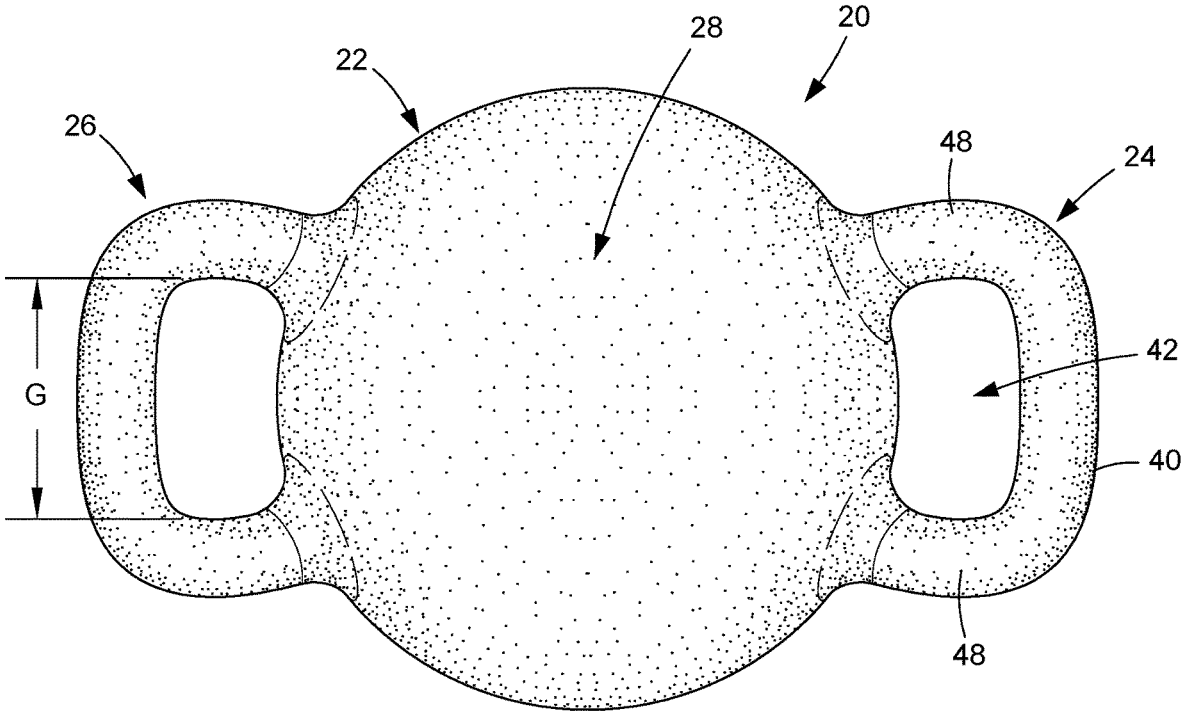
FIG. 2 is a top view of the exercise device of FIG. 1.

In one embodiment, the body 22 is generally spheroidal in shape. In particular, as illustrated in FIG. 2, the body 22 may be generally circular in shape in a cross-section taken horizontally through the body 22 at the center C thereof. For example, the body 22 may have a diameter D of about 7-8 inches from side to side at the centerline C, but a height H from top 28 to bottom 30 of only about 4-5 inches (as described below, the body 22 may have other sizes, such that when the body 22 is larger or smaller, the ratio of the diameter D to the height H (D/H) is preferably relatively constant, at about 1.5:1-2.5:1, and most preferably about 2:1).

Figure 5:
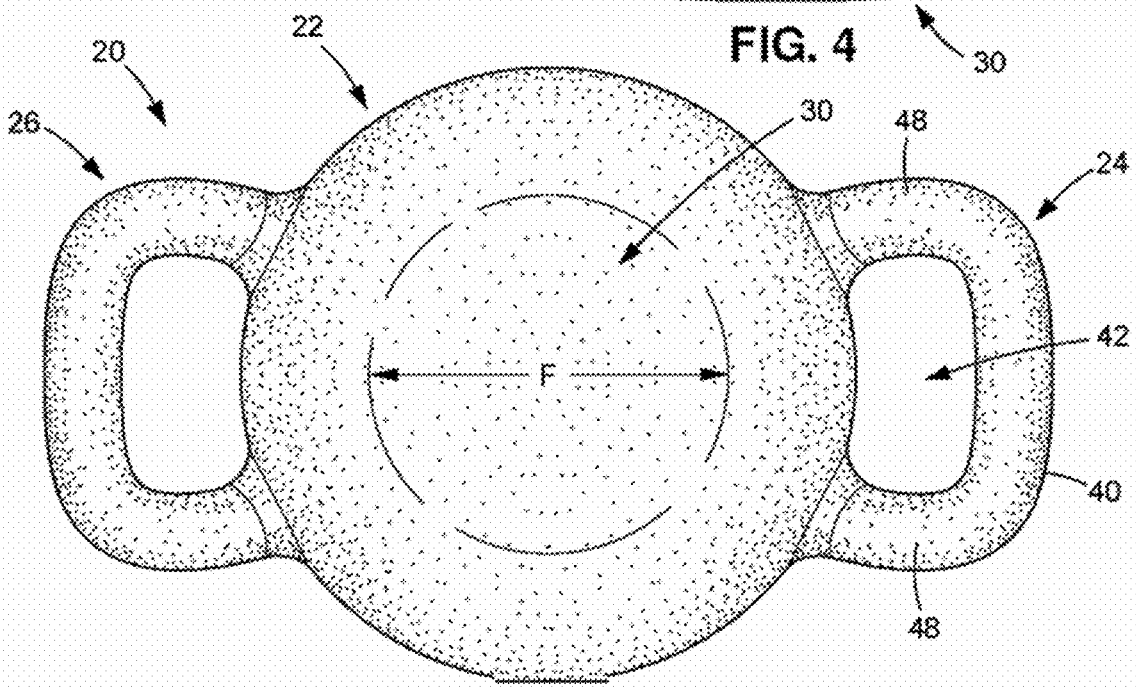
FIG. 5 is a bottom view of the exercise device of FIG. 1.

In a preferred configuration, the bottom 30 defines a planar surface or face. As illustrated in FIG. 5, the planar area may have a diameter F of about 4-5 inches (wherein, when the size of the body 22 changes, the diameter F preferably changes in relation to the diameter D, wherein the ratio of F to D (F/D) is about 1:1.5-1:2.5, and most preferably about 1:2). It is possible, although less preferred, for a portion of the top 28 to also be planar.

As indicated, the first and second handles 24,26 extend outwardly from the opposing sides 32,34 of the body 22. In one embodiment, each handle 24,26 is generally formed as a loop, having first and second ends which connect to the body and a central grip 40 via legs or connecting portions 48. In one configuration, the grip 40 is about 1.5 inches in diameter.

The handles 24,26 cooperate with the body 22 to define a passage 42, whereby the grip 40 is spaced from the body 22. In one embodiment, the grip 40 is spaced outwardly from the body 22 by about 4 inches. However, as described below, this distance preferably changes, such as depending upon the size of the body 22, so that the distance between the grips 40 is generally the same.

Figure 3:
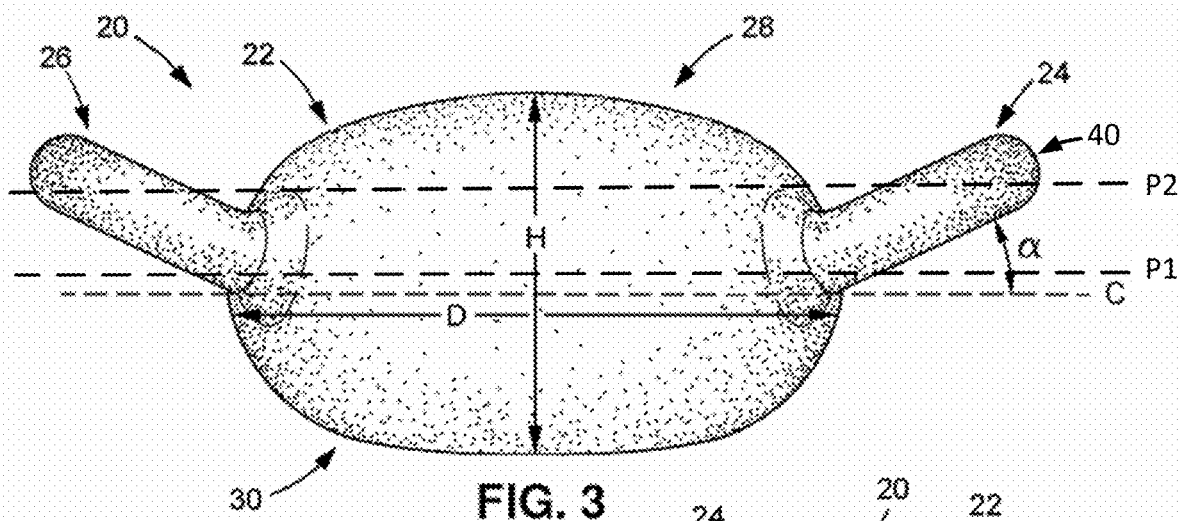
FIG. 3 is a front view of the exercise device of FIG. 1.
Figure 4:
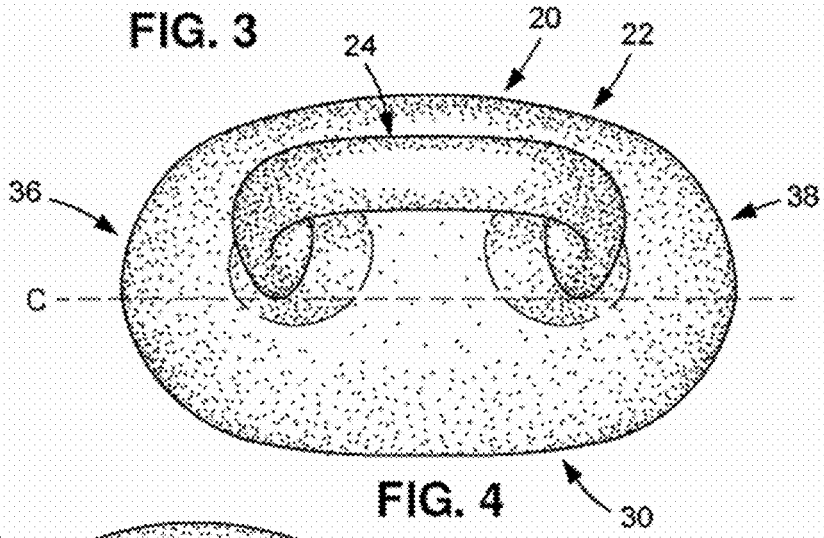
FIG. 4 is a side view of the exercise device of FIG. 1.

As best illustrated in FIG. 3, in a preferred embodiment, the handles 24,26 extend outwardly from the sides 34,36 of the body 22, but also extend upwardly towards the top 28 of the body 22. In one embodiment, the handles 24,26 extend upwardly at an angle $\alpha$ of about 20-30 degrees, and most preferably about 25 degrees, relative to a horizontal plane P1 (such as through the ends of the handles at their connections to the body). As best illustrated in FIGS. 3 and 4, this preferably causes the grips 40 to be located an elevation which is closer to the top 28 of the body 22 than the ends of the handles at their connection to the body 22). In other words, grips 40 may be located in a second horizontal plane P2 separated from horizontal plane P1.

The exercise device 20 may be constructed from various materials. In one embodiment, the exercise device 20 is intended to have a relatively large mass. As such, at least the body 22 may be constructed from metal (such as cast from iron) or a similar material. In embodiment, the handles 24,26 may be constructed as part of the body 22. In other embodiments, they might be removable. The body 22 and handles 24,26 might be coated, such as with rubber, plastic or other durable material, and/or material which aids the user in gripping the exercise device 20.

In general, the exercise device 20 may be gripped by a user and used to engage in various exercises.

As indicated above, the exercise device 20 may be configured to have one of a particular number of masses. For example, the exercise device 20 might be configured to have a mass of 30 pounds, 50 pounds, 70 pounds, or other masses (in this regard, one aspect of the invention may be a plurality, such as a set, of exercise devices 20 having different masses). In each case, the total mass of the exercise device 20 preferably includes the body 22 and the handles 24,26.

In one configuration, the size of the body 22 changes depending upon the mass of the exercise device 20. As indicated above, the size of the body 22 may change proportionally.

Figure 6A:
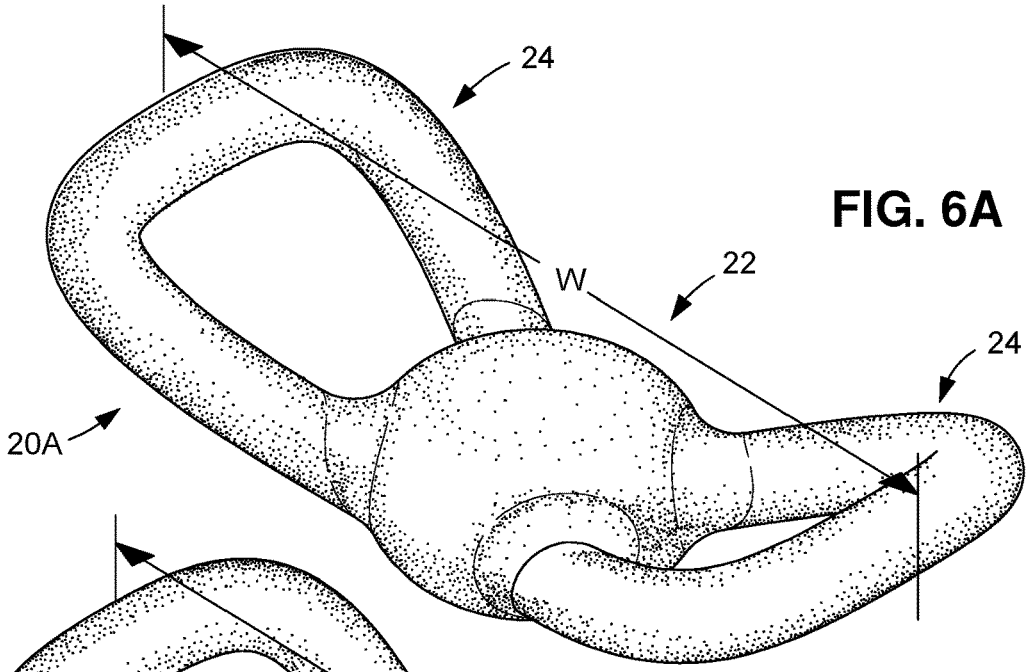
FIGS. 6A, 6B and 6C comparatively illustrate exercise devices having different masses in accordance with embodiments of the invention.
Figure 6B:
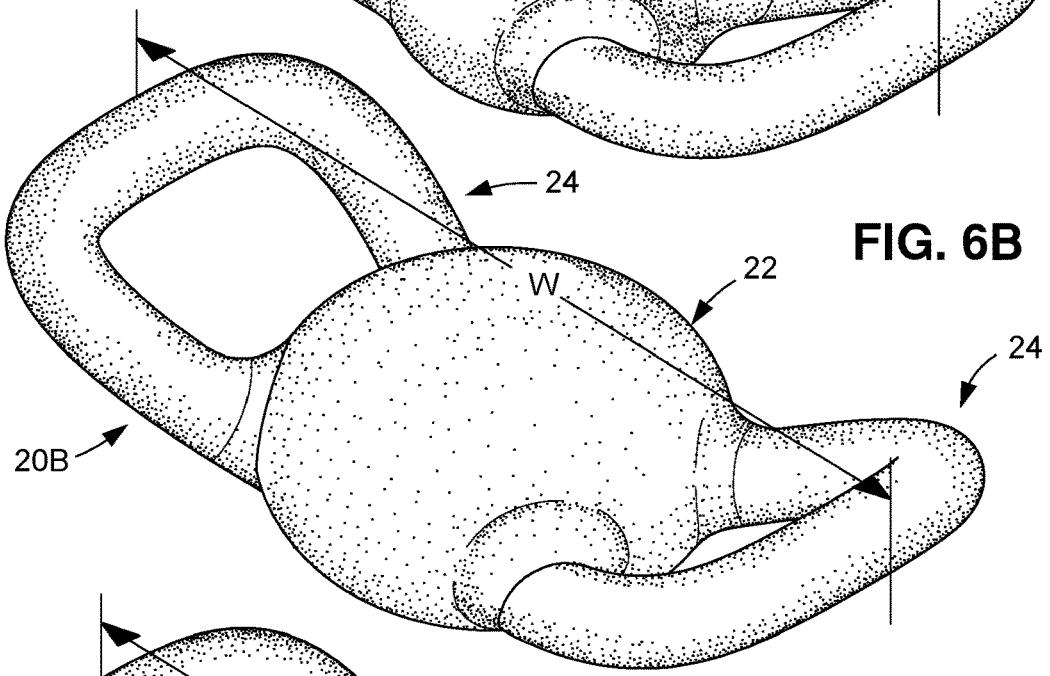
Figure 6C:
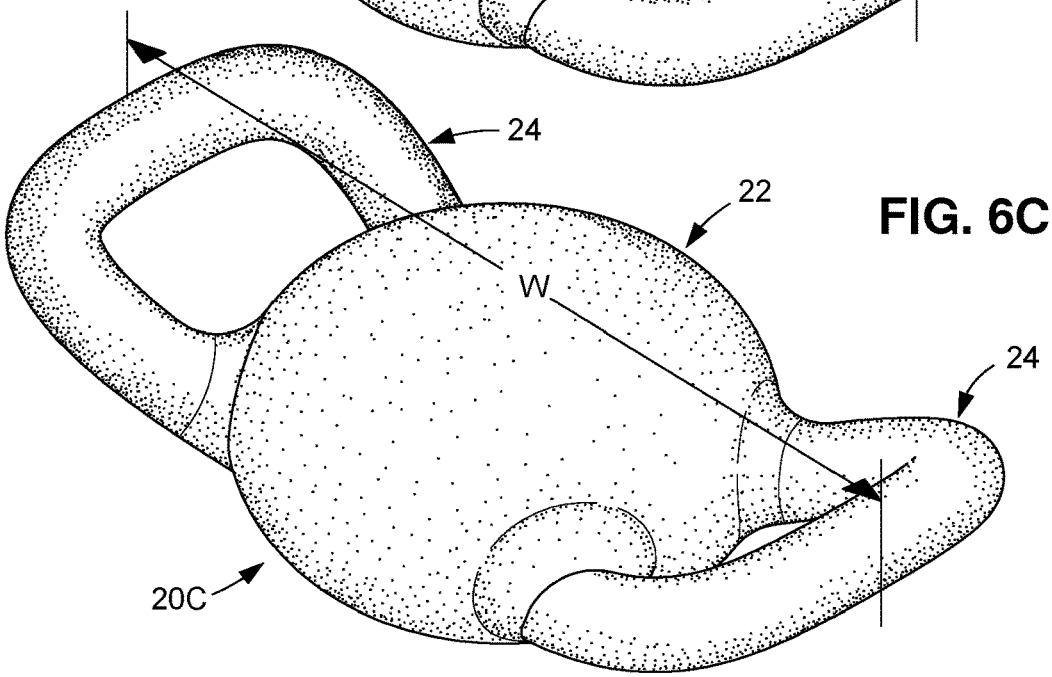

Preferably, however, a total width of the exercise device 20 remains the same, regardless of the mass of the exercise device (and the size of the body). For example, FIGS. 6A, 6B and 6C illustrate exemplary configurations of a 30 pound exercise device 20A, a 50 pound exercise device 20B and a 70 pound exercise device 20C. In each case, a total width W of each exercise device is the same. The total width W is preferably about 16.5 inches. As illustrated, this means that when the body is smaller in diameter, the handles are longer/extend outwardly from each side of the body farther, and when the body is larger in diameter, the handles are shorter/extend outwardly from each side of the body less distance. In each case, however, the handles preferably extend from the body at the orientation described above.

Similarly, in order to provide the user with the same grip 40, the handle of each device has a grip of essentially the same size and shape—including grip width (which in one embodiment as illustrated in FIG. 2, is a distance G of about 4.5 inches). As illustrated, this may result in the connecting portions of the handle 24 extending at different angles relative to the grip portion so that they can connect to the body 22 (e.g. when the body is smaller, the connecting portions of the handle must be located closer to one another at the body and then angle outwardly to form the grip).

The exercise device 20 has a number of advantages. First, the exercise device 20 has two handles 24,26, and importantly, the handles are at opposing sides, thus allowing the user to pick up and exercise with the device 20 using one or two hands. When gripped with two hands, the body 22 of the exercise device 20 may then be located between the user's arms.

Another advantage of the invention is the orientation of the handles 24,26 at an angle. For example, a user may grip the handles 24,26 and then pull the body 22 towards their chest. Because the handles 24,26 angle upwardly, the grips 40 are located closer to the top 28 of the body (than the center or bottom thereof), thus allowing the user to pull body 22 close to themselves (e.g. where the top 28 may be positioned very close to their body). This has advantages relative to a number of exercises. At the same time, the user might wish to engage in other exercises in which they grasp the handles 24,26 to that the bottom 30 of the body 22 is facing them.

Another advantage is that the generally planar bottom 30 allows a user to place the exercise device 20 on a support surface without rolling away or tipping over, and reduces the height H of the body 22. This concentrates the mass of the body 22 along the centerline C (see FIG. 3). When exercising, this allows the user to place the center of mass of the exercise device 20 close to themselves (and closer than if the body 22 was taller, such as if the body 22 was spherical).

One advantage to the exercise device 20 is that it permits exercising with a neutral grip (one in which the user's palms face one another during the exercise). In particular, unlike kettle bells and other exercise devices which have a single handle at the top and barbells, the dual handle configuration of the exercise device 20 of the present invention allows a user to grip the device 20 with both hands and with the palms facing one another (e.g. in a neutral grip configuration). This has a number of significant advantages, including, but not limited to:

(1) The neutral grip helps resist impingement compared to other traditional grips.
(2) This is a safer grip for protecting shoulders.
(3) The neutral grip puts your body in correct/safe alignment for desired workout.
(4) Gives the individual flexibility based on the intended movement.
(5) Creates the option for more triceps focused workout on push movement which creates less strain on the shoulders.
(6) Individuals are not able to perform neutral grip with a traditional barbell.
(7) This grip is ideal for rehabilitative movements.
(8) It is not ideal to hold one traditional dumbbell with both hands for neutral grip as it's not as comfortable and can be more dangerous and lead to injury.
(9) The exercise device provides the ability for a secure grip to perform desired exercises/movements.

Additional advantages of the invention are realized due to the double handle configuration thereof, including, but not limited to:

(1) The double handle offers a safer and more ideal starting point to individuals not be able to perform traditional single arm kettlebell/dumbbell exercises/movements.
(2) Traditional one arm movements can be more difficult compared to a double handle device.
(3) Single arm movements with a traditional dumbbell or kettlebell can create an increased chance for poor form.
(4) The double handle allows for more control along with correct alignment throughout desired movement.
(5) The double handle can assist the individual obtain a more ideal position to perform an exercise/movement before transitioning into a more traditional movements/exercises with a kettlebell and dumbbell for unilateral use.
(6) Currently existing dumbbells or similar device to not allow users to use two hands as effectively and safely.
(7) The traditional kettlebell does not offer effective/safe use for bilateral neutral grip performance.

In general, the exercise device of the invention offers a safer alternative for all ages, and/or less skilled individuals performing movements/exercises while holding overhead, or in front of body. It also offers ability to perform full body muscle building workouts, high intensity interval training, as well as accessory/rehabilitative movements.

Of course, the user might engage in a wide variety of exercises with the exercise device 20 other than those specifically stated herein.

Further, the exercise device 20 might have other configurations. For example, the body 22 might define a plurality of openings or the like, such as for selectively receiving balls, cylinders or other shaped elements for increasing and/or decreasing the total mass of the body 22.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An exercise device comprising:

a generally spheroidal body having a top, a bottom, a first side, a second side opposite the first side, a front, and a rear;

a first handle extending outwardly from and being connected to said first side, said first handle comprising a first end and a second end each extending from said first side at a first elevation with respect to said bottom, and a grip spaced from said body; and a second handle extending outwardly from and being connected to said second side, said second handle comprising a first end and a second end each extending from said second side at a second elevation with respect to said bottom, and a grip spaced from said body, said second elevation being the same as said first elevation along a first horizontal plane;

wherein said first and second handles extend upwardly towards said top of said body at an angle of about 25 degrees relative to said first horizontal plane through said body, and wherein said first and second handles are spaced apart at opposing sides of said body and each of said first and second handles extends from said body in in said first horizontal plane between the top and the bottom of said body, with said grip of said first handle and said grip of said second handle each being disposed in a second horizontal plane offset towards said top of said body from said first horizontal plane.

2. The exercise device in accordance with claim 1, wherein a size of said body increases as a mass of said exercise device increases.

3. The exercise device in accordance with claim 2, wherein a distance between said grip of said first handle and said grip of said second handle remains generally constant as said size of said body changes.

4. The exercise device in accordance with claim 3, wherein said distance is about 16.5 inches.

5. The exercise device in accordance with claim 2, wherein said angle remains generally constant as said size of said body changes.

6. The exercise device in accordance with claim 2, wherein a width of said grip of said first handle and a width of said grip of said second handle remains generally constant as said size of said body changes.

7. The exercise device in accordance with claim 1, wherein a central portion of said bottom of said body is generally planar.

8. The exercise device in accordance with claim 7, wherein said planar portion has a diameter F and said body has a diameter D between said sides, wherein a ratio of the F/D is about 1:1.5-1:2.5.

9. The exercise device in accordance with claim 8, wherein said ratio F.D is about 1:2.

10. The exercise device in accordance with claim 1, wherein the body has a diameter D between said sides and a height H from said top to said bottom, wherein a ratio of the diameter D to the height H (D/H) is preferably between 1.5:1 and 2.5:1.

11. The exercise device in accordance with claim 10, wherein said ratio is about 2:1.

12. The exercise device in accordance with claim 1, wherein said body and handles are cast as a single element.

13. A plurality of exercise devices comprising:

a first exercise device having a first mass, comprising:

a generally spheroidal body having a top, a bottom, a first side, a second side opposite the first side, a front, and a rear, said body having a first size;

a first handle extending outwardly from and being connected to said first side, said first handle comprising a first end and a second end each extending from said first side at a first elevation with respect to said bottom, and a grip spaced from said body; and a second handle extending outwardly from and being connected to said second side, said second handle comprising a first end and a second end each extending from said second side at a second elevation with respect to said bottom, and a grip spaced from said body, said second elevation being the same as said first elevation along a first horizontal plane;

a second exercise device having a second mass which differs from said first mass, comprising:

a generally spheroidal body having a top, a bottom, a first side, a second side opposite the first side of said second exercise device, a front, and a rear, said body having a second size;

a first handle extending outwardly from and being connected to said first side, said first handle comprising a first end and a second end each extending from said first side of said second exercise device at a third elevation with respect to said bottom of said second exercise device, and a grip spaced from said body; and a second handle extending outwardly from and being connected to said second side, said second handle comprising a first end and a second end each extending from said second side of said second exercise device at a fourth elevation with respect to said bottom of said second exercise device, and a grip spaced from said body, said fourth elevation being the same as said third elevation along another first horizontal plane;

wherein said first and second handles of said bodies of said first and second exercise devices extend upwardly towards said tops of said bodies at an angle of about 25 degrees relative to said respective first horizontal plane through said bodies, wherein said first and second handles of said first and second exercise devices are spaced apart at opposing sides of said bodies and each of said first and second handles extends from said bodies in said respective first horizontal plane between the tops and the bottoms of said bodies, with said grips of said first handles and said grips of said second handles each being disposed in a respective second horizontal plane offset towards said tops of said bodies from said first horizontal planes, and wherein a first distance between said grips of said first and second handles of said first exercise device is generally the same a second distance between said grips of said first and second handles of said second exercise device.

14. The plurality of exercise devices in accordance with claim 13, wherein each body has a diameter D between said sides and a height H from said top to said bottom, wherein a ratio of the diameter D to the height H (D/H) is preferably between 1.5:1 and 2.5:1.

15. The plurality of exercise devices in accordance with claim 14, wherein said ratio is about 2:1.

16. The plurality of exercise devices in accordance with claim 13, wherein each body has a generally planar portion at said bottom, said generally planar portion having a diameter F and wherein each body has a diameter D between said sides, wherein a ratio of the F/D is about 1:1.5-1:2.5.

17. The plurality of exercise devices in accordance with claim 16, wherein said ratio F.D is about 1:2.

18. The plurality of exercise devices in accordance with claim 13, wherein said first and second distances are each about 16.5 inches.

* * * * *